US006076513A

United States Patent [19]

Doherty et al.

[11] Patent Number: 6,076,513

[45] Date of Patent: Jun. 20, 2000

[54] TRIGGER OPERATED BOW TYPE TOY GUN

[75] Inventors: Gregory J. Doherty, Cincinnati, Ohio; Karl Christopherson, Independence, Ky.

[73] Assignee: Hasbro, Inc., Pawtucket, R.I.

[21] Appl. No.: 09/108,719

[22] Filed: Jul. 1, 1998

[51] Int. Cl.[7] ..... F41B 11/00

[52] U.S. Cl. ..... 124/66

[58] Field of Search ..... 124/66, 60, 63, 124/64, 65; 446/180

[56] References Cited

U.S. PATENT DOCUMENTS

| | | | |
|---|---|---|---|
| D. 337,796 | 7/1993 | Sutyak | D21/145 |
| 2,214,224 | 9/1940 | Douglas . | |
| 2,937,638 | 5/1960 | Rauglas | 124/65 |
| 3,253,586 | 5/1966 | Strauss | 124/65 |
| 3,262,440 | 7/1966 | Kuhn . | |
| 3,765,396 | 10/1973 | Kienholz et al. | 124/13 R |
| 3,859,977 | 1/1975 | Lange | 124/14 |
| 4,732,136 | 3/1988 | Ferri . | |
| 4,848,307 | 7/1989 | Tsao . | |
| 4,850,329 | 7/1989 | Taylor et al. | 124/68 |
| 5,193,517 | 3/1993 | Taylor et al. | 124/67 |
| 5,242,323 | 9/1993 | Rappaport | 446/180 |
| 5,267,549 | 12/1993 | Webber . | |
| 5,343,850 | 9/1994 | Steer . | |
| 5,377,655 | 1/1995 | Arad | 124/65 |
| 5,377,656 | 1/1995 | Lewinski et al. . | |
| 5,429,108 | 7/1995 | Hsieh | 124/65 |
| 5,522,374 | 6/1996 | Clayton . | |
| 5,553,598 | 9/1996 | Johnson et al. . | |
| 5,605,140 | 2/1997 | Griffin | 124/59 |
| 5,724,954 | 3/1998 | Smith | 124/66 |
| 5,738,079 | 4/1998 | Keller et al. | 124/66 |

*Primary Examiner*—Charles T. Jordan
*Assistant Examiner*—Jeffrey Howell
*Attorney, Agent, or Firm*—Marshall, O'Toole, Gerstein, Murray & Borun

[57] ABSTRACT

A toy gun for launching foam projectiles includes a forward housing having a launch chamber and a rearward housing slidably connected to the forward housing. The rearward housing is adapted to be shiftable between a forward or retracted position disposed within or generally adjacent to the forward housing and an extended position. A releasable latch is provided which is adapted to engage the rearward housing as the rearward housing is shifted to the extended position, thereby maintaining the rearward housing in the extended position. A pneumatic launcher having a spring operated plunger, an actuating trigger, and a compression chamber in flow communication with the launch chamber is disposed within the forward and rearward housings. The plunger is shiftable to between a cocked position in response to rearward movement of the rearward housing toward the extended position and is retained by the actuating trigger. Upon release of the actuating trigger, the plunger advances thus launching a projectile in a conventional manner. A portion of the plunger operatively engages the releasable latch to disengage the latch in response to forward movement of the plunger upon release of the trigger, thereby permitting the rearward housing to return to a forward position.

22 Claims, 7 Drawing Sheets

38
39
34
92
34
94
94
90
94
75
89
82
76
64
64
89
76
82
74
26
70
30
52
68
24

34
74
30
80
74
80
64
82
89
76
78
78
76
92
75
75
82
94
90
94
87
84
87
85
85

TRIGGER OPERATED BOW TYPE TOY GUN

FIELD OF THE INVENTION

The present invention relates generally to toy gun for launching foam projectiles. More specifically, the present invention relates to a toy gun resembling a bow and arrow or cross-bow type weapon.

BACKGROUND AND SUMMARY OF THE INVENTION

Toy air guns that launch a foam projectile using a blast of compressed air are generally well known in the art. Because such guns launch an actual projectile, they satisfy a child's desire for realism. More importantly, because the projectiles are soft, the guns satisfy a parent's desire for safety. However, the attention span of a typical child is relatively limited, and thus the most popular toy guns are those which incorporate a variety of complex, realistic, and futuristic features. Accordingly, there is a continuing need for increasingly complex, realistic and futuristic toy guns that will enhance the play value of the toy, stimulating a child's imagination.

The toy gun according to the present invention incorporates the safety of a pneumatic soft foam projectile launcher with a number of complex and futuristic features. The toy gun according to the present invention resembles a bow and arrow or crossbow type of weapon, and includes a pneumatic launcher assembly having a reciprocating plunger which is adapted to launch a projectile in response to forward movement of the plunger.

According to one aspect of the invention, a toy gun for launching foam projectiles includes a forward housing having a launch chamber and a rearward housing slidably connected to the forward housing. The rearward housing is adapted to be shiftable between a forward or retracted position disposed within or generally adjacent to the forward housing and an extended position. A releasable latch is provided which is adapted to engage the rearward housing as the rearward housing is shifted to the extended position, thereby maintaining the rearward housing in the extended position. A pneumatic launcher having a spring operated plunger, an actuating trigger, and a compression chamber in flow communication with the launch chamber is disposed within portions of the forward and rearward housings, and the plunger is shiftable between a cocked position retained by the actuating trigger and a forward position upon release of the actuating trigger. Upon release of the trigger, the plunger advances thus launching a projectile in a conventional manner. The plunger is shiftable to the cocked position in response to rearward movement of the rearward housing toward the extended position. A portion of the plunger operatively engages the releasable latch to disengage the latch in response to forward movement of the plunger upon release of the trigger, thereby permitting the rearward housing to return to the forward position.

The releasable latch preferably includes a latch member adapted to reciprocate along an axis generally perpendicular to a longitudinal axis of the plunger. The rearward housing includes a cylindrical portion sized to be received within the forward housing, and the latch member is shiftable to an inward engaged position wherein the releasable latch engages an annular flange on the exterior surface of the cylindrical portion. Preferably, the latch member includes a curved edge which abuts the annular flange when the latch is in the engaged position. The releasable latch is preferably mounted to the forward housing, and a spring is provided for biasing the latch member toward the inward engaged position, thus maintaining the rearward housing in the extended position. The cylindrical portion of the rearward housing preferably includes a longitudinal slot, and a portion of the latch member extends into the slot. Accordingly, the rearward housing can slide back and forth without interruption by the latch member. The plunger includes an outwardly extending flange disposed generally adjacent and parallel to the slot, such that the flange coacts with and releases the releasable latch upon forward movement of the plunger, thereby permitting the rearward housing to shift toward the forward position. Preferably, each of the plunger flange and the latch member includes an angled camming surface.

In accordance with another aspect of the invention, a toy gun for launching a foam projectile includes an extensible housing assembly and a pneumatic launcher assembly operatively connected to the housing assembly. The extensible housing assembly is shiftable between a retracted position and an extended position, and the housing assembly including a releasable latch for maintaining the housing assembly in the extended position. A launch chamber is defined in the forward portion of the housing assembly. The pneumatic launcher includes a plunger, a trigger, and a compression chamber in flow communication with the launch chamber for launching a foam projectile from the launch chamber in a conventional manner. The plunger is shiftable along a longitudinal axis between a cocked position retained by the trigger and a forward position upon release of the trigger, with the plunger being shiftable to the cocked position in response to movement of the housing assembly toward the extended position. A portion of the pneumatic launcher is operatively connected to the releasable latch to thereby disengage the latch in response to forward movement of the plunger, thus permitting the housing assembly to return to its retracted position.

In accordance with a further aspect of the invention, a toy gun includes an extensible housing assembly shiftable between a retracted position and an extended position. A portion of the housing assembly defines a launch chamber. A pneumatic launcher assembly mounted thereto includes a plunger, a trigger, and a compression chamber in flow communication with the launch chamber. The plunger is shiftable along a longitudinal axis between a cocked position retained by the trigger and a forward position upon release of the trigger for launching a projectile. Latch means are provided for retaining the housing assembly in the extended position. The latch means are releasable in response to forward movement of the plunger to thereby permit the housing assembly to move to its retracted position upon release of the trigger.

The aforementioned features and advantages, in addition to other features and advantages, will become readily apparent to those skilled in the art upon a reading of the following detailed description.

DETAILED DESCRIPTION OF THE PREFERRED EMBODIMENT

Figure 1:
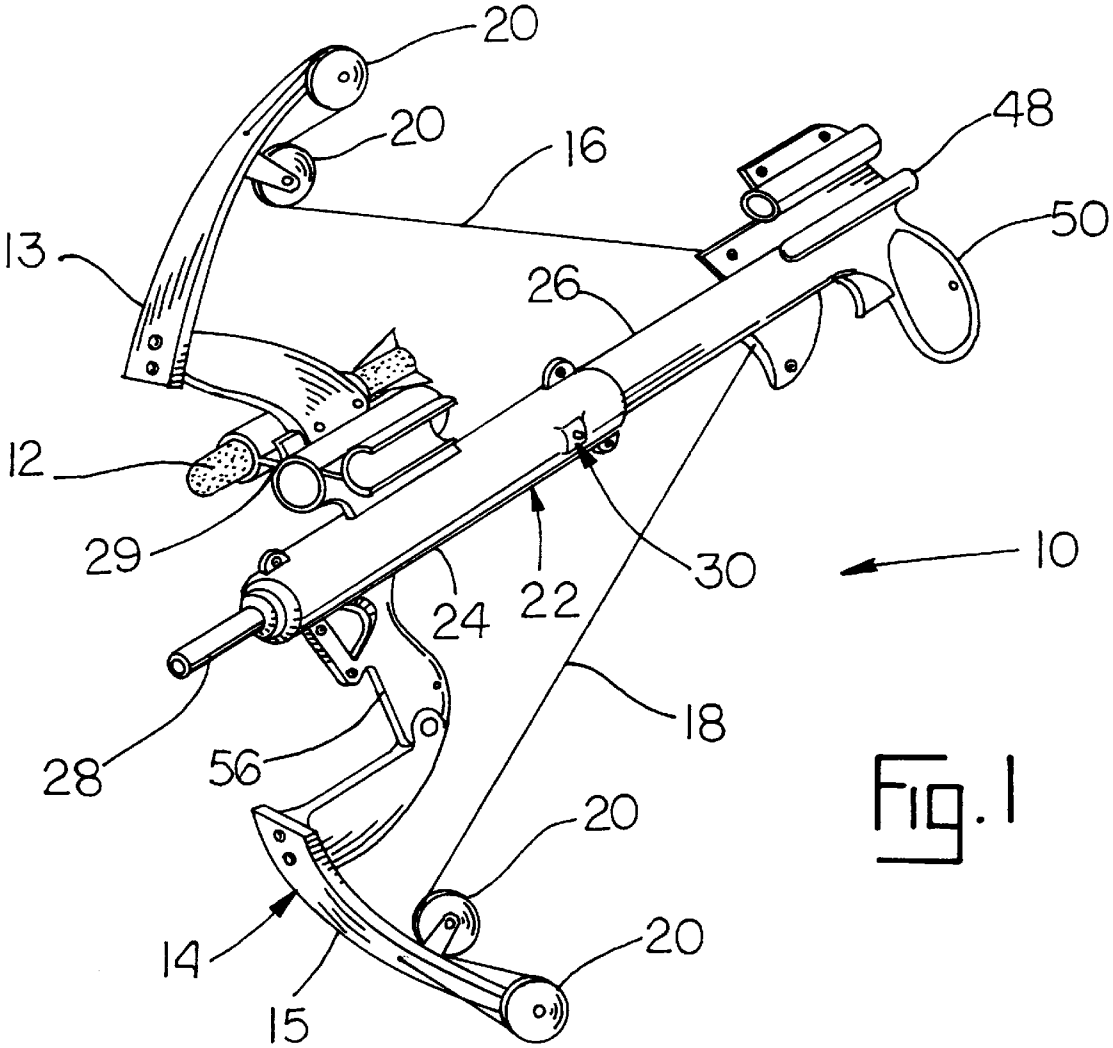
FIG. 1 is a perspective view of a toy gun constructed in accordance with the teachings of the present invention and which is shown in a cocked or extended position.

The embodiment described herein is not intended to be exhaustive or to limit the scope of the invention to the precise form disclosed. The following embodiment has been chosen and described in order to best explain the principles of the invention and to enable others skilled in the art to follow its teachings.

Referring now to the drawings, a toy gun constructed in accordance with the teachings of the present invention is generally referred to by the reference numeral 10 and is adapted to launch a foam projectile 12. In the preferred embodiment, the toy gun 10 includes a bow assembly 14 having upper and lower flexible members 13, 15 supporting upper and lower bowstrings 16, 18, respectively. The bowstrings 16, 18 are attached to to flexible members 13, 15 and are routed over a plurality of pulleys 20, thus lending a bow and arrow or crossbow type appearance to the toy gun 10. Other configurations for the toy gun 10 may also be contemplated.

Figure 2:
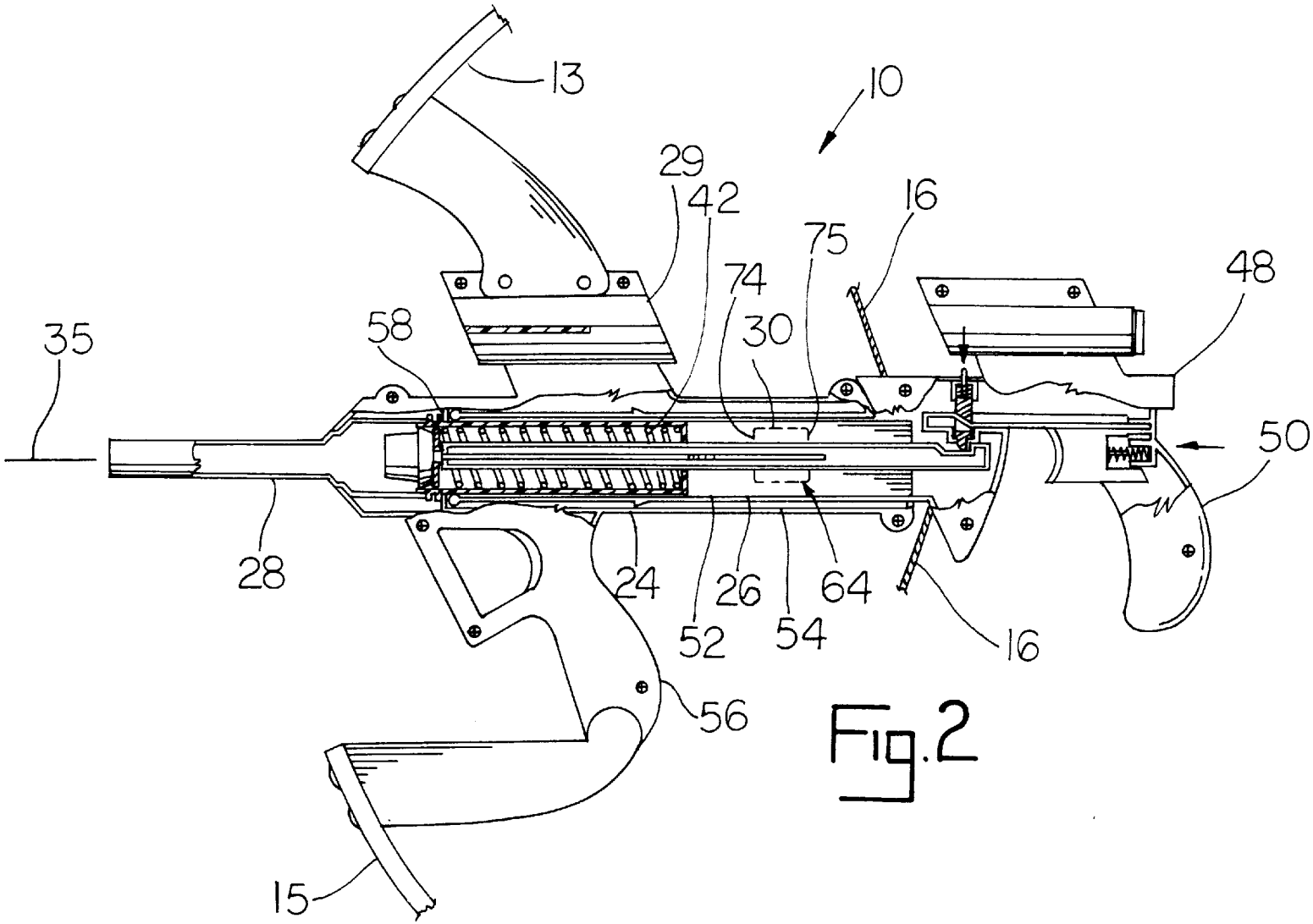
FIG. 2 is an enlarged fragmentary cross-sectional view of the toy gun shown in FIG. 1 but shown in an uncocked or retracted position.
Figure 3:
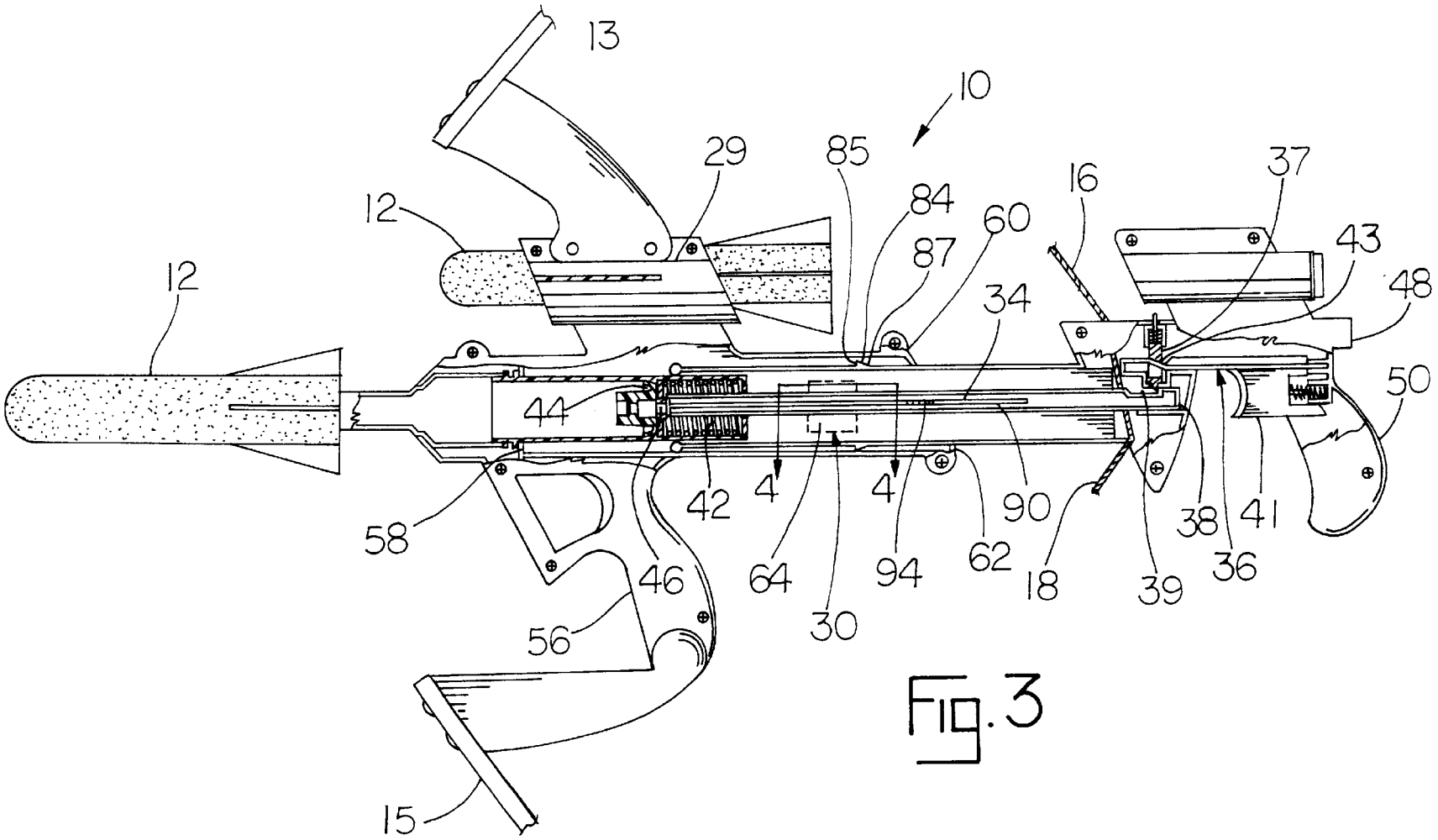
FIG. 3 is an enlarged cross-sectional view similar to FIG. 2 but showing the toy gun in the cocked or extended position and showing a projectile in place on the launch chamber.
Figure 5:
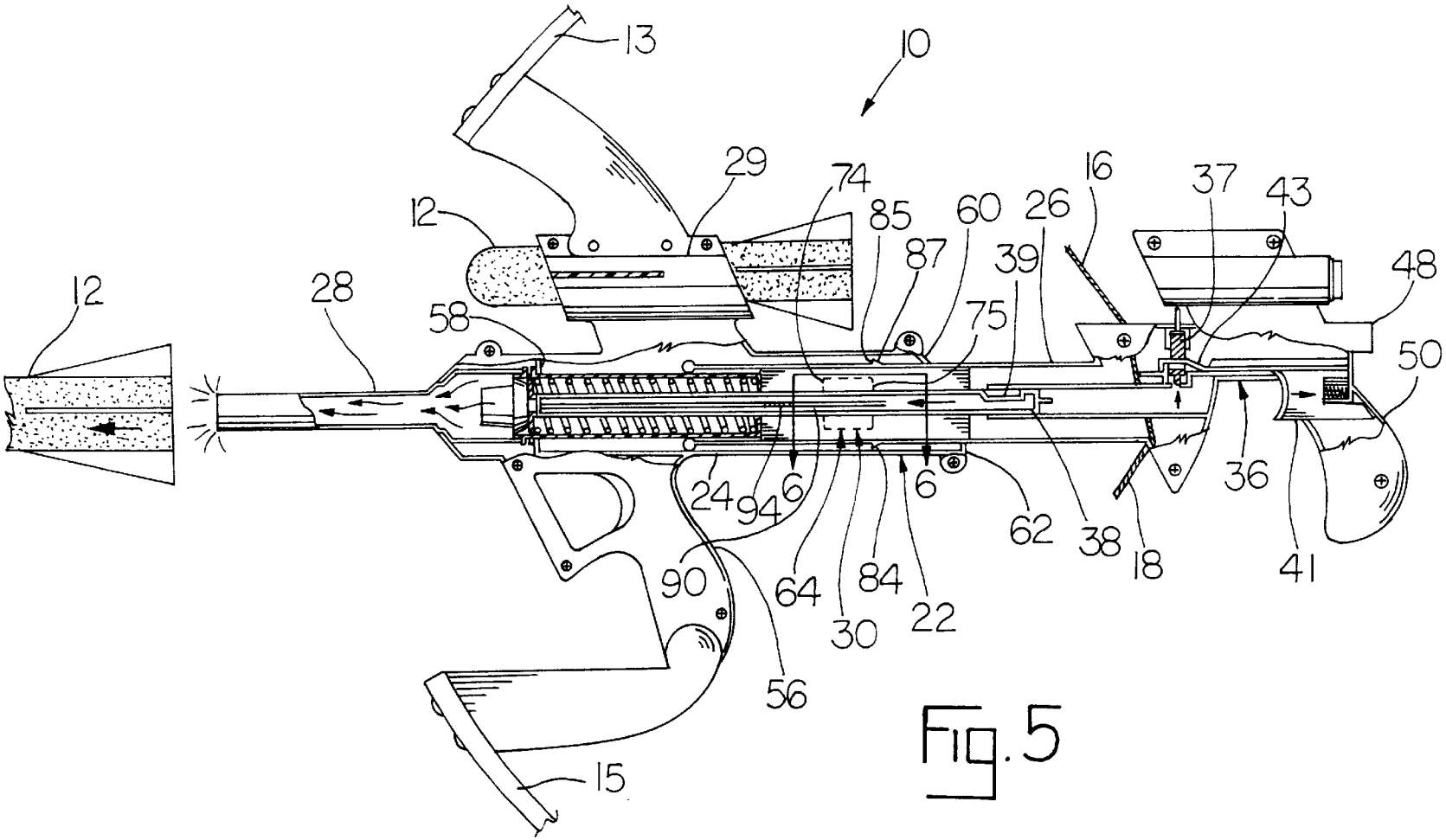
FIG. 5 is an enlarged cross-sectional view similar to FIG. 2 but showing the plunger of the pneumatic launcher advancing subsequent to firing the toy gun.
Figure 7:
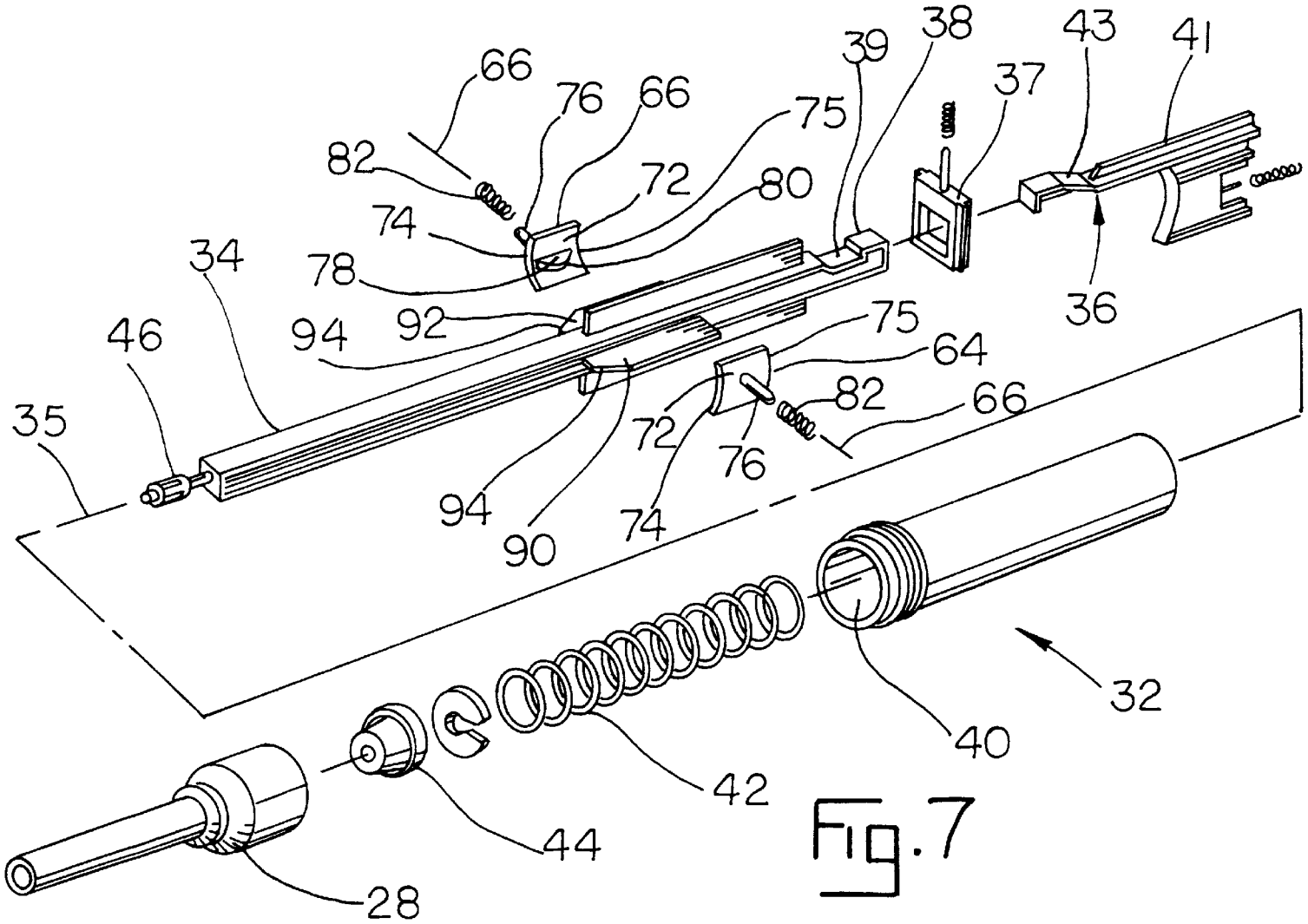
FIG. 7 is an enlarged exploded view in perspective of the plunger, the latch mechanism and a portion of the cylindrical rearward housing.

The toy gun 10 includes a housing assembly 22 consisting of a forward housing 24 and a rearward housing 26, which are slidably mounted to each other as will be explained in greater detail below. A launch chamber or station 28 is defined in a portion of the forward housing 24, which launch station 28 receives the foam projectile 12 in a manner well known to those of skill in the art and as shown in FIG. 3. Alternatively, one or more foam projectiles may be stored on a storage rack 29 as shown in FIG. 1. The forward housing 24 and the rearward housing 26 are slidably mounted to each other, such that the rearward housing 26 is shiftable relative to the forward housing 24 between the forward or retracted position as shown in FIGS. 2 and 5 and the extended or rearward position as shown in FIGS. 1 and 3. A releasable latch assembly 30 is mounted to the forward housing 24 and engages the rearward housing 26 when the rearward housing 26 is in the extended position of FIG. 3 for maintaining the rearward housing 26 in the extended position.

As shown in FIGS. 2, 3, 5 and 7, a pneumatic launcher assembly 32 of the type commonly employed in the art is disposed within the toy gun 10 such that portions of the pneumatic launcher assembly 32 lie within both of the forward and rearward housings 24, 26. The pneumatic launcher assembly includes a plunger 34, a trigger assembly 36 adapted to engage a notch 39 in the rearward end 38 of the plunger 34, and a compression chamber 40 in flow communication with the launch station 28. As shown in FIGS. 2, 3 and 5, the trigger assembly 36 preferably is mounted within the rearward housing 26 in a position to engage the rearward end 38 of the plunger 34. Alternatively, the trigger assembly 36 could be mounted within the forward housing 24 in a position to engage another portion of the plunger 34. The trigger assembly 36 includes a reciprocating latch member 37 which is actuated by an angled surface 43 on a reciprocating finger pull 41. The plunger 34 is moveable along a generally longitudinal axis 35 between the forward position as shown in FIGS. 2 and 5 and the rearward or cocked position as shown in FIG. 3. A spring 42 is provided for advancing the plunger 34 in a manner well known in the art, such that a seal 44 at the forward end 46 of the plunger 34 causes air to be compressed within the launch station 28, thereby causing the foam projectile 12 to be launched from the launch station 28 as the plunger 34 is advanced by the spring 42.

As shown in each of FIGS. 1 through 6, the forward and rearward housings 24, 26 are shiftably mounted to each other so as to permit the toy gun 10 to be shifted between the uncocked or retracted position as shown in FIGS. 2 and 5 and the cocked or extended position as shown in FIGS. 1 and 3. The rearward housing 26 includes a rearward end 48 having a handle 50, and also includes a generally cylindrical forward end 52. The forward housing 24 includes a longitudinal cavity 54 sized to receive therein the pneumatic launcher 32. The cavity 54 is also adapted to slidably receive therein the cylindrical forward end 52 of the rearward housing 26. Alternatively, the rearward housing 26 could be slidably mounted on a longitudinal track or any other suitable structure that would permit longitudinal movement of the rearward housing 26 relative to the forward housing 24. The forward housing 24 includes a handle 56, and also includes a forward stop 58 and a rearward stop 60 having a flange 62. The forward stop 58 generally defines the extreme forward position of the rearward housing 26 within the cavity 54. The rearward stop 60 and the flange 62 prevent the rearward housing 26 from being inadvertently withdrawn from the forward housing 24.

Referring now to FIGS. 4, 6, 7 and 8, the latch assembly 30 includes a pair of substantially identical latch members 64, each of which is mounted to the forward housing 24 so as to be reciprocable along an axis 66. Axis 66 lies generally perpendicular to the longitudinal axis 35 of the plunger 34. Preferably, each latch member 64 is disposed on opposite sides 68, 70 of the forward housing 24 so as to lie on diametrically opposite sides of the cavity 54 and hence the cylindrical portion 52 of the rearward housing 26. Alternatively, the latch members 64 may include a rotatable pawl or other rotatable or shiftable retaining structures. Further, although two latch members 64 are shown, it is contemplated that a single latch member may be employed. Further, the function, structure and operation of both of the latch members 64 is identical, except for their respective positions relative to the axis 35 of the plunger 34.

Each latch member 64 includes a curved inner flange 72 having a forward edge 74 and a rearward edge 75. A lug or post 76 extends outwardly from the inner flange 72. The curvature of the inner flange 72 substantially matches the curvature of the cylindrical portion 52 of the rearward housing 26. A lug 78 extends inwardly from the inner flange 72 and includes an angled surface 80. A spring 82 is provided for biasing the latch member 64 inwardly toward the axis 35 of the plunger 34, such that the latch member 64 is shiftable along a generally linear path between the inward position of FIG. 4 and the outward position of FIG. 6. The post 76 and the spring 82 are received in a housing 89 of the forward housing 24, such that a portion of the post 76 projects therefrom.

Figures 4, 6:
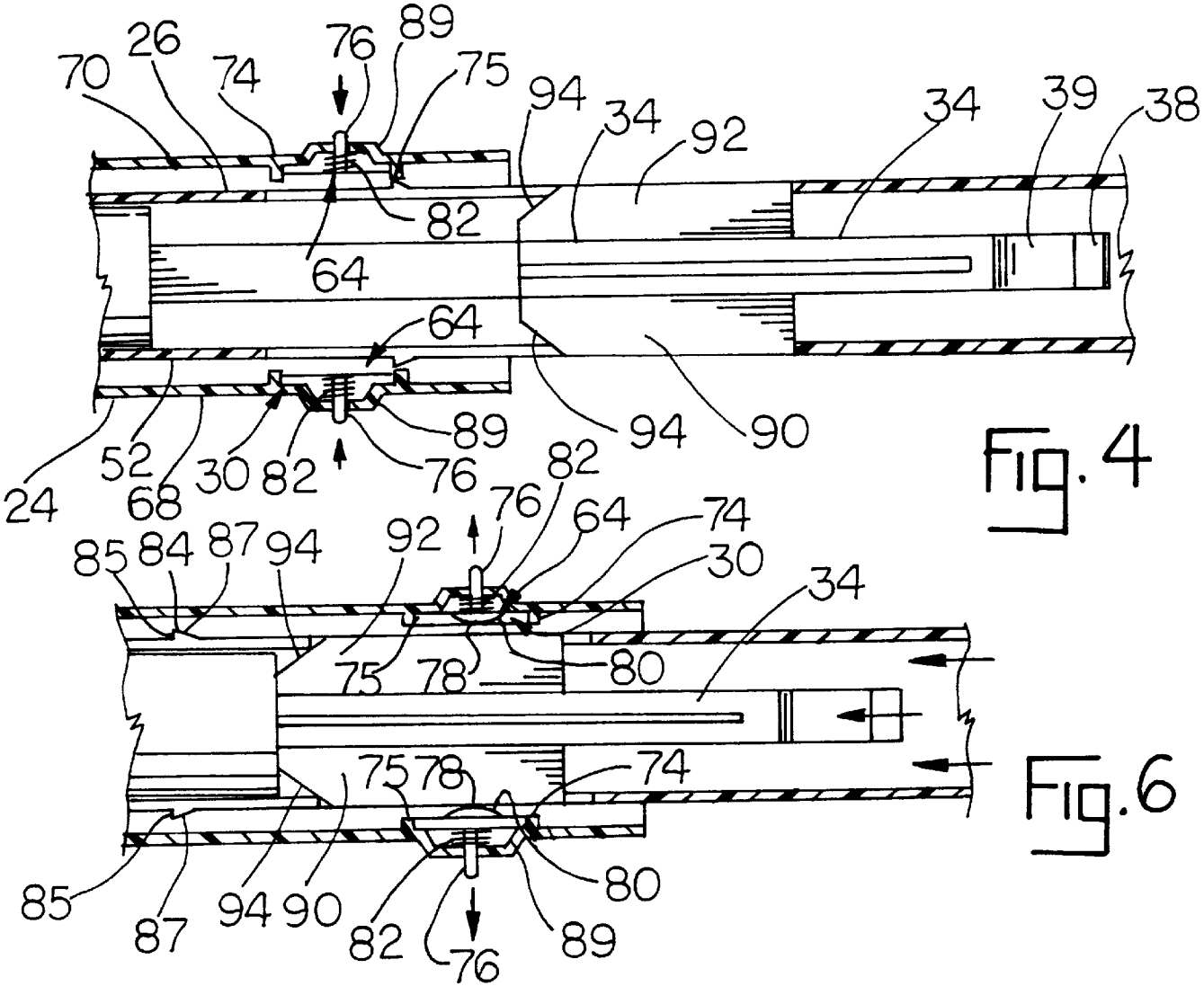
FIG. 4 is an enlarged fragmentary cross-sectional view taken along lines 4—4 of FIG. 3 and illustrating the latch mechanism for retaining the toy gun in the cocked or extended position.
FIG. 6 is an enlarged fragmentary cross-sectional view taken along lines 6—6 of FIG. 5 and illustrating the outwardly extending flanges of the plunger contacting and releasing the latch mechanism to allow the rearward housing to return to a forward position.
Figure 8:
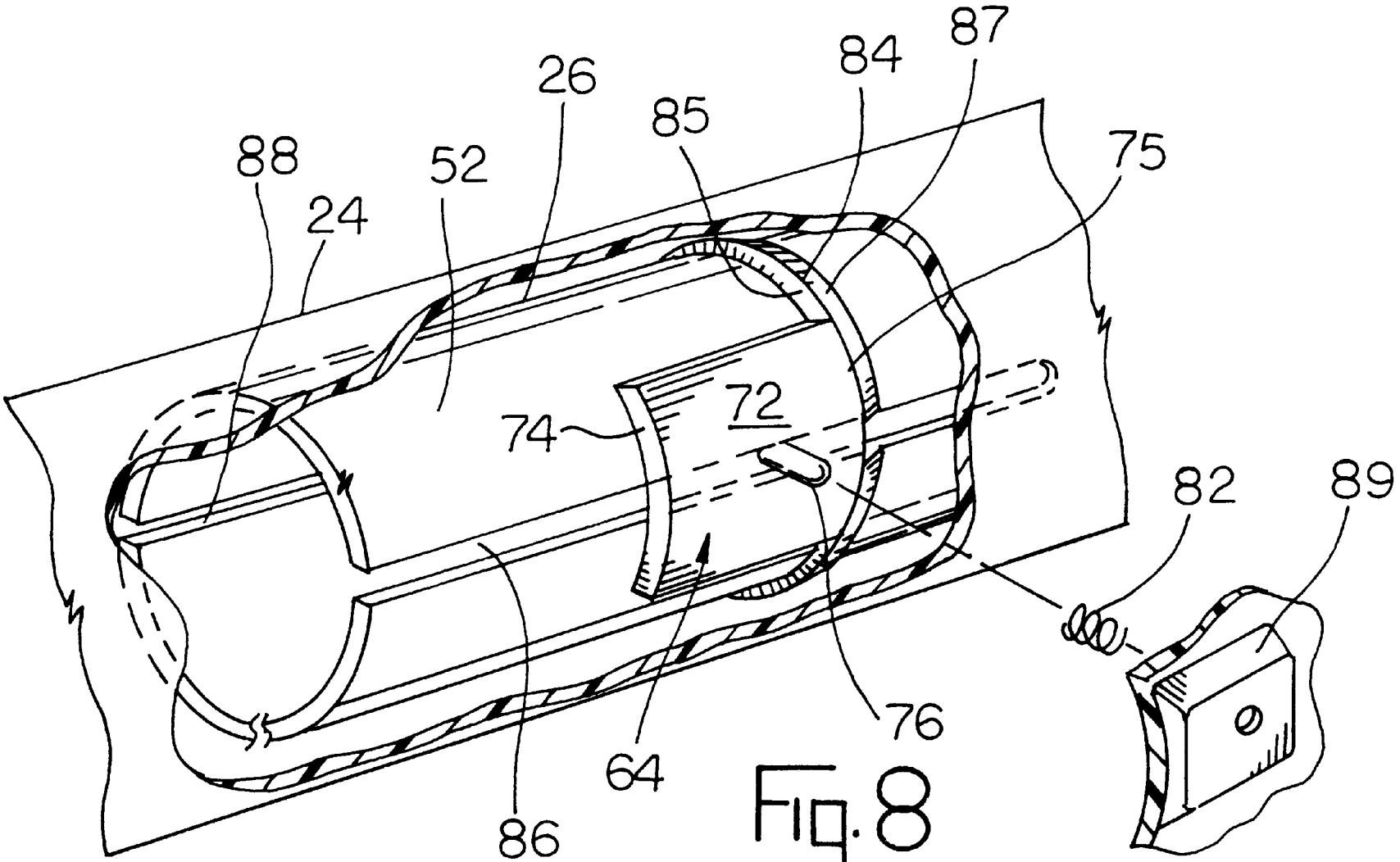
FIG. 8 is an enlarged fragmentary view in perspective of the spring biased latch member shown in a position to engage the annular flange on the rearward housing.

As shown to advantage in FIGS. 4, 6 and 8, the cylindrical forward end 52 of the rearward housing 26 includes an annular flange 84 and a pair of longitudinal slots 86, 88. The annular flange 84 includes a forward edge 85 and a rearwardly facing angled surface 87. The rearward edge 75 of the curved inner flange 72 abuts the forward edge 85 of the annular flange 84 when the latch member 64 is in an engaged position, which occurs when the rearward housing is in the cocked, extended position thus retaining the rearward housing 26 in the extended rearward position. The slots 86, 88 are sized to receive a portion of the lug 78 of the adjacent latch member 64. As shown in FIG. 8, the annular flange 84 is interrupted in the region of the slots 86, 88. As shown in FIGS. 4 and 6, the plunger 34 includes a pair of outwardly extending flanges 90, 92 extending from opposite sides of the plunger 34. Each of the flanges 90, 92 is disposed so as to be aligned with and generally adjacent to the slots 86, 88 and the latch members 64 when the rearward housing 26 is in the cocked extended position. Each of the flanges 90, 92 includes an angled forward surface 94, which is positioned to contact or cam against the angled surface 80 of the adjacent latch member 64 when the plunger 34 is advancing upon firing of the toy gun 10. The flanges 90, 92 shift the latch members 64 outwardly, thereby allowing the rearward housing 26 to be moved forwardly relative to the forward housing 24.

In operation, the foam projectile 12 is placed on the launch chamber in a conventional manner in preparation for firing the toy gun 10, either before or after the toy gun 10 has been cocked. The user (not shown) positions the rearward housing 26 in a forward position abutting the forward stop 58, which enables the trigger latch 37 to the engage the notch 39 in the rearward end 38 of the plunger 34. The user then retracts the rearward housing 26 by pulling in a rearward direction on the handle 50 (i.e., to the right when viewing the Figures), which pulls the rearward housing 26 toward the rearward stop 60, and which simultaneously draws the plunger 34 rearwardly against the biasing force of the spring 42.

As the rearward housing 26 is retracted, the latch members 64 slide along the surface of the cylindrical forward end 52 of the rearward housing 26 until the curved forward edges 74 contact and cam against the angled surface 87 of the annular flange 84, thus forcing the latch members 64 outwardly against the restoring force of their respective springs 82. As soon as the annular flange 84 passes the rearward edge 75, the springs 82 force the latch members 64 inwardly such that the rearward edges 75 contact and abut the leading edge 85 of the annular flange 84, thus securing the rearward housing 26 in the cocked extended position with the plunger 34 also in the cocked position. The toy gun 10 is now ready to fire the projectile 12 from the launch station 28.

Upon retraction of the finger pull 41 by the user, the latch member 37 is moved upwardly by the angled surface 43, so that the latch member 37 disengages the notch 39 at the rearward end 38 of the plunger 34. The spring 42 advances the plunger 34 in a rapid manner, thus compressing air within the launch station 28 in a conventional manner, which thus launches the projectile 12.

As the plunger 34 advances, the angled surfaces 94 on the flanges 90, 92 contact and cam against the rearward edges 75 of the latch members 64, forcing the latch members 64 outwardly and compressing the springs 82. Consequently, the rearward edges 75 release the forward edge 85 of the annular flange 84. The flanges 90, 92 prevent the latch members 64 from moving inwardly, and the rearward housing is again ready to be moved to the forward position. The process is then repeated when it is desired to fire another projectile 12 form the toy gun 10.

It will be understood that the above description does not limit the invention to the above-given details. It is contemplated that various modifications and substitutions can be made without departing from the spirit and scope of the following claims.

What is claimed:

1. A toy gun for launching a foam projectile, comprising:

a forward housing having a launch chamber;

a rearward housing slidably connected to the forward housing, the rearward housing being shiftable between a forward position disposed adjacent the forward housing and an extended position;

a releasable latch adapted to engage the rearward housing as the rearward housing is shifted to the extended position for maintaining the rearward housing in the extended position; and a pneumatic launcher having a spring operated plunger, an actuating trigger, and a compression chamber in flow communication with the launch chamber, the plunger being shiftable between a cocked position retained by the actuating trigger and a forward position upon release of the actuating trigger, the plunger being shiftable to the cocked position in response to movement of the rearward housing toward the extended position, a portion of the plunger being operatively connected to the releasable latch to disengage the latch in response to forward movement of the plunger upon release of the trigger, thereby permitting the rearward housing to return to the forward position.

2. The toy gun of claim 1, wherein the releasable latch includes a latch member, the latch member being adapted to reciprocate along an axis perpendicular to a longitudinal axis of the plunger.

3. The toy gun of claim 1, wherein the rearward housing includes a cylindrical portion sized to be received within the forward housing, and further wherein the releasable latch is shiftable to an inward engaged position wherein the releasable latch engages an exterior surface of the cylindrical portion.

4. The toy gun of claim 3, wherein the releasable latch includes a latch member having a curved inner portion and wherein the cylindrical portion exterior surface includes an annular flange, the latch member curved inner portion including an edge for abutting the annular flange when the latch is in the engaged position.

5. The toy gun of claim 1, wherein the releasable latch is mounted to the forward housing and includes a shiftable latch member for engaging the rearward housing when the rearward housing is in the extended position.

6. The toy gun of claim 2, wherein the latch member includes a spring for biasing the latch member toward an inward engaged position in which the latch member maintains the rearward housing in the extended position.

7. The toy gun of claim 4, wherein the rearward housing includes a slot and further wherein the latch member includes a lug sized to be received in the slot.

8. The toy gun of claim 7, wherein the slot extends longitudinally along the cylindrical portion of the rearward housing.

9. The toy gun of claim 7, wherein the plunger includes an outwardly extending flange disposed generally adjacent and parallel to the slot, the flange being adapted to coact with the releasable latch upon forward movement of the plunger to thereby shift the releasable latch to an outward released position, thereby permitting the rearward housing to shift toward the forward position.

10. The toy gun of claim 9, wherein each of the plunger flange and the latch member inner portion includes an angled camming surface.

11. A toy gun for launching a foam projectile, comprising:

an extensible housing assembly, the housing assembly being shiftable between a retracted position and an extended position, the housing assembly including a releasable latch for maintaining the housing assembly in the extended position, a portion of the housing assembly further defining a launch chamber; and a pneumatic launcher assembly operatively connected to the housing assembly, the pneumatic launcher assembly having a plunger, a trigger, and a compression chamber in flow communication with the launch chamber, the plunger being shiftable along a longitudinal axis between a cocked position retained by the trigger and a forward position upon release of the trigger, the plunger being shiftable to the cocked position in response to movement of the housing assembly toward the extended position, a portion of the pneumatic launcher assembly being operatively connected to the latch to thereby disengage the latch in response to forward movement of the plunger, thereby permitting the housing assembly to move to its retracted position.

12. The toy gun of claim 11, wherein the housing assembly includes a forward housing and a rearward housing shiftably mounted to the forward housing.

13. The toy gun of claim 12, wherein the releasable latch includes a latch member, the latch member being adapted to reciprocate along an axis perpendicular to a longitudinal axis of the plunger.

14. The toy gun of claim 12, wherein the rearward housing includes a cylindrical portion sized to be received within the forward housing, and further wherein the releasable latch is shiftable to an inward engaged position wherein the releasable latch engages an exterior surface of the cylindrical portion.

15. The toy gun of claim 14, wherein the releasable latch includes a latch member having a curved inner portion and wherein the cylindrical portion exterior surface includes an annular flange, the latch member curved inner portion including an edge for abutting the annular flange when the releasable latch member is in the inward engaged position.

16. The toy gun of claim 13, wherein the releasable latch is mounted to the forward housing and includes a shiftable latch member adapted to engage a portion of the rearward housing when the housing assembly is in the extended position.

17. The toy gun of claim 13, wherein the latch member includes a spring for biasing the latch member toward an inward engaged position in which the latch member maintains the rearward housing in the extended position.

18. The toy gun of claim 12, wherein the rearward housing includes a slot and further wherein the latch assembly includes a shiftable latch member sized to be received in the slot.

19. The toy gun of claim 18, wherein the slot extends longitudinally along a cylindrical portion of the rearward housing.

20. The toy gun of claim 18, wherein the plunger includes an outwardly extending flange disposed generally adjacent and parallel to the slot, the flange being adapted to coact with the latch member upon forward movement of the plunger to thereby shift the latch member to an outward released position, thereby permitting the rearward housing to shift toward the forward position.

21. The toy gun of claim 20, wherein each of the plunger flange and the latch member includes an angled camming surface.

22. A bow-type toy gun for launching a foam projectile, comprising:

an extensible housing assembly, the housing assembly being shiftable between a retracted position and an extended position, a portion of the housing assembly defining a launch chamber;

upper and lower flexible members attached to the extensible housing assembly and supporting a bowstring;

a pneumatic launcher assembly having a plunger, a trigger, and a compression chamber in flow communication with the launch chamber, the plunger being shiftable along a longitudinal axis between a cocked position retained by the trigger and a forward position upon release of the trigger; and a latch adapted to retain the housing assembly in the extended position, the latch being releasable in response to forward movement of the plunger to thereby permit the housing assembly to move to its retracted position upon release of the trigger.

* * * * *